United States Patent [19]

Chobanian et al.

[11] 4,348,930

[45] Sep. 14, 1982

[54] TRANSDUCER FOR SENSING STRING VIBRATIONAL MOVEMENT IN TWO MUTUALLY PERPENDICULAR PLANES

[76] Inventors: Dennis A. Chobanian, P.O. Box 3067, Eldorado Springs, Colo. 80025; R. Alan McNaughton, Rte. 1, Golden, Colo. 80401

[21] Appl. No.: 115,267

[22] Filed: Jan. 25, 1980

[51] Int. Cl.[3] ..... G10H 3/00

[52] U.S. Cl. ..... 84/1.15; 84/1.16

[58] Field of Search ..... 333/148, 201; 367/156; 84/1.14, 1.15, 1.16; 336/135

[56] References Cited

U.S. PATENT DOCUMENTS

| | | | |
|---|---|---|---|
| 2,493,388 | 1/1950 | Candy | 336/135 |
| 2,584,984 | 2/1952 | Camras | 336/135 |
| 3,045,196 | 7/1962 | Packard | 336/135 |
| 3,983,778 | 10/1976 | Bartolini | 84/1.16 |
| 4,143,575 | 3/1979 | Oliver | 84/1.16 |
| 4,248,120 | 2/1981 | Dickson | 84/1.16 |

*Primary Examiner*—J. V. Truhe

*Assistant Examiner*—Forester W. Isen

*Attorney, Agent, or Firm*—John R. Ley

[57] ABSTRACT

Two magnetically permeable pole pieces have pole faces of predetermined configuration formed thereon, and the pole pieces conduct magnetic flux which interacts with a magnetically permeable string of a stringed instrument. The positioning of the pole faces, the geometric configuration of the pole faces relative to the string, and the predetermined pattern of magnetic flux emanated from the pole faces are arranged so that vibrational movement of the string in one plane creates significant magnetic flux changes in a first pole piece and minimal or no flux changes in the second pole piece. String vibrational movement in a second plane mutually perpendicular to the first plane creates significant magnetic flux changes in the second pole piece and minimum or no flux changes in the first pole piece. The magnetic flux changes are sensed and electrical signals related to the flux changes are derived. The electrical signals are supplied directly to audio amplifying equipment.

15 Claims, 7 Drawing Figures

TRANSDUCER FOR SENSING STRING VIBRATIONAL MOVEMENT IN TWO MUTUALLY PERPENDICULAR PLANES

BACKGROUND OF THE INVENTION

This invention relates to stringed instruments and more particularly to a new and improved transducer for separately sensing the vibrational movement of a string of the stringed instrument in two mutually perpendicular planes and for supplying separate electrical signals related to the vibrational movement of the string in each of the two mutually perpendicular planes.

Transducers or pick-ups as they are commonly called have been widely employed in a variety of different electric guitars and other stringed instruments for the purpose of deriving electrical signals corresponding to the vibrational movement of the string. The electrical signals are then amplified and supplied to speakers to obtain an amplified sound over that which would be available from vibration of the string itself. A significant portion of musicians playing guitars and similar stringed instruments utilize instruments employing transducers.

The typical prior art transducer employs a pole piece of magnetically permeable material which conducts and emanates magnetic flux. The pole piece is positioned sufficiently close to the string so the vibratory movement of the string toward and away from the pole piece changes the reluctance through the air gap adjacent the pole piece. Reluctance changes cause the flux in the pole piece to change in a related manner, and the flux changes induce the electrical signals. Conventional transducer assemblies typically sense vibrational movement of the strings in a plane perpendicular to the plane collectively defined by all the strings of the instrument.

It is known that a string which is plucked or strummed will typically vibrate in a complex pattern. The center point of a plucked string may vibrate in a linear, circular, oval, figure eight or a variety of other complex patterns. Prior art transducers, however, have sensed the string movement only in a single plane, although the actual audible effect created by the vibrating string itself may contain frequencies and effects which are distinguishable from the vibrational movement of the string in that single plane. Consequently the electrical signals generated by the prior art single-sensing plane transducers may not accurately reflect the sound effect created by the vibrating string.

Certain prior art transducers have even attempted to eliminate the effects of the string vibrations in planes other than the single-sensing plane. U.S. Pat. No. 3,453,920 discloses a piezo-type bridge pick-up for a guitar. Two piezoelectric crystals are mechanically contacted with the string at a bridge to sense any string vibration. The piezoelectric crystals are mechanically oriented to sense horizontal and vertical string vibrations, although the crystals may also dampen the string movement. The piezoelectric crystals are electrically connected to electrically cancel the signals developed from the horizontal string vibration.

Prior art relating to deriving signals representative of the string vibration in two mutually perpendicular planes is disclosed in U.S. Pat. No. 4,143,575. The arrangement described in U.S. Pat. No. 4,143,575 employs a pair of radio frequency coils oriented with their axes in non-intersecting relation with each string, a signal generator for conducting radio frequency signals through each string of the stringed instrument, signal processing circuitry including an AM detector for detecting the modulation in the radio frequency signal of the string as sensed by the radio frequency coils, and an amplifier and speaker for amplifying the audio signal obtained from the AM detector. The radio frequency signal processing equipment and radio frequency coils have heretofore been regarded as necessary to detect string vibration in each of the two mutually perpendicular planes with sufficient signal separation to obtain two audibly distinguishable signals from string vibration in the two mutually perpendicular planes.

Other shortfalls and deficiencies in the development in this art may be known. In general, however, a greater appreciation for the significance of the present invention should be revealed by a more complete understanding of the previous developments in this art.

SUMMARY OF THE INVENTION

General objectives of the present invention are to provide a new and improved variable reluctance and flux transducer for sensing the vibrational movement of a string in two mutually perpendicular planes, which has the significant advantages and features of more perfectly reproducing the complex movement of the vibrating string, which allows an accomplished musician to obtain two distinguishable audio effects from a single vibrating string and to increase the distinctiveness of the playing style of the musician, which can be utilized with conventional audio amplifying equipment without the necessity of costly complex signal processing equipment and the like, and which can be utilized with various signal processing equipment to obtain unique musical effects. Another objective is simply to increase the number and distinctiveness of sounds attainable from a stringed instrument utilizing an electrical transducer for sensing the string vibration.

The transducer of the present invention can generally be summarized as comprising a pair of pole pieces, means for creating magnetic flux flowing through the pole pieces and means for sensing changes in magnetic flux. A pole face of predetermined configuration is formed on each pole piece. The predetermined configuration of the pole faces emanates the magnetic flux flowing out of the pole pieces into a predetermined pattern in the air gap in the vicinity of the string. Vibrational movement of the string in one plane parallel to the magnetic flux pattern emanated from the pole face of the first pole piece induces minimal or insignificant flux changes in the second pole piece, and vice versa. In this manner, vibrational movement of the string in one plane is sensed independently of, and with a minimum of influence over, the sensing of the vibrational movement of the string in the other mutually perpendicular plane.

The present invention is defined in the appended claims. A more complete understanding of the invention can be obtained from the following description of its preferred embodiments and from the drawings consisting of a number of figures.

DESCRIPTION OF PREFERRED EMBODIMENTS

Figure 1:
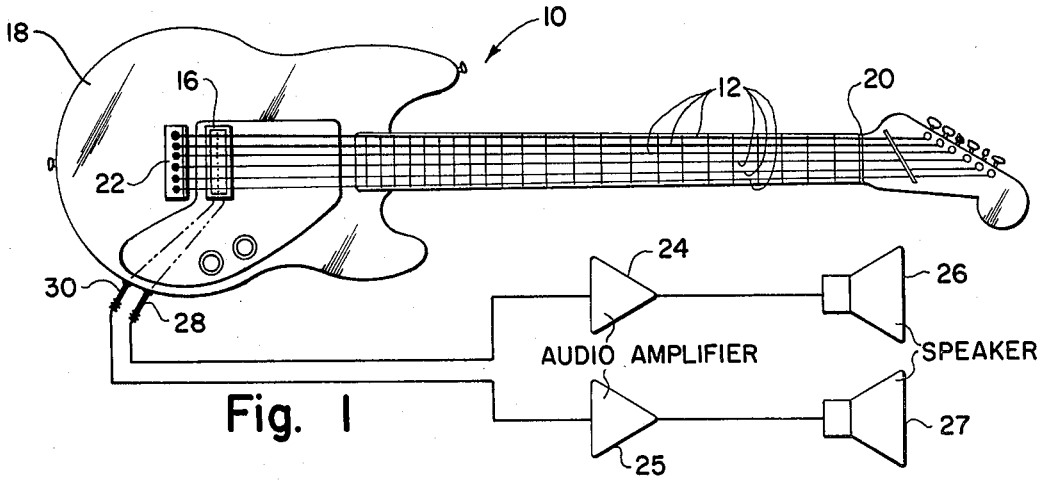
FIG. 1 is a generalized view of a guitar to which there is attached a transducer assembly including at least one transducer according to the present invention. Electrical output terminals for the transducer assembly and various other electrical apparatus are also schematically illustrated.

The present invention is intended for use in conjunction with a stringed instrument such as a guitar 10 which has a plurality of strings 12, as shown in FIG. 1. The present invention is embodied by one or more individual transducers 14 illustrated in FIGS. 2, 3 and 4. The transducers 14 of the present invention sense the vibratory motion of the strings 12 in essentially two mutually perpendicular planes and provide separate signals relating to the string vibratory motion in each of the two mutually perpendicular planes. Prior art transducers or pick-ups are commonly employed for essentially sensing the vibratory motion of the string in only a single plane.

When plucked or strummed the string 12 will typically vibrate in various complex patterns and not in a single plane. The complex patterns result essentially because of the non-uniform manner in which the string is plucked or because of multiple angles of attack on the string by the picking device. Any complex pattern will involve components of vibration or movement in two mutually perpendicular planes extending parallel to the string under non-vibratory conditions, designated as an X plane and a Y plane in FIG. 2. In fact, any movement of the string, except in a single plane parallel to either the X plane or the Y plane, will involve a component of movement in both planes. The transducer 14 of the present invention separately senses the component of string vibratory movement in each of the two mutually perpendicular X and Y planes and provides separate electrical signals relating to the vibratory motion of the string in each plane.

Figure 6:
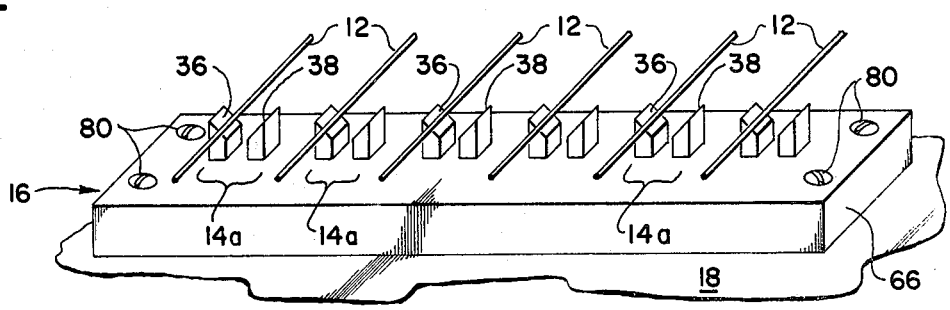
FIG. 6 is a perspective view of one transducer assembly including a number of individual transducers positioned relative to the strings of the guitar shown in FIG. 1.

The transducers 14 are typically assembled into a transducer assembly 16 and attached to the guitar or stringed instrument as shown in FIGS. 1 and 6. The transducer assembly 16 is preferably positioned below a plane defined by the plurality of strings 12 and is connected to a body 18 of the guitar 10. The transducer assembly 16 is positioned between two bridges 20 and 22 of the guitar 10 over which the strings 12 pass. The bridges 20 and 22 thus define the maximum longitudinal length along which the string 12 is allowed to vibrate, since the bridges dampen the string vibrations to the guitar body. The transducer assembly 16 is positioned at some point along the suspended length of the strings where they undergo vibrational movement as a result of stimulation by plucking, strumming, bowing, impacting, or the like.

Figure 2:
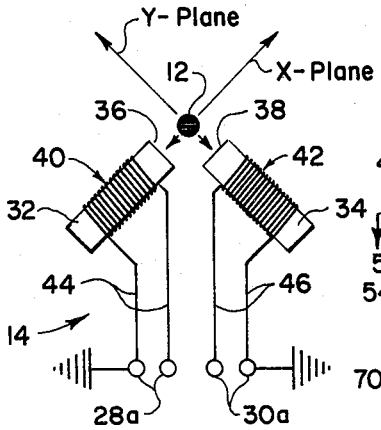
FIG. 2 is a generalized schematic view of a transducer illustrating certain principles and elements of the transducer in operative relation with one string of a guitar or other stringed instrument, in accordance with the invention.
Figure 7:
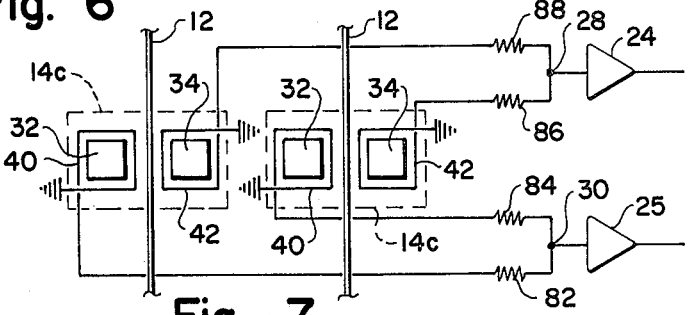
FIG. 7 is one exemplary electrical connection of two transducers of the transducer assembly.

Separate electrical signals respectively representative of the string motion or vibration in each of the two mutually perpendicular planes are directly supplied to audio amplifiers 24 and 25 which drive speakers 26 and 27, as shown in FIG. 1. The signal supplied to amplifier 24 represent the string vibratory motion in one of the two mutually perpendicular planes, and the signal applied to amplifier 25 represents the string vibratory motion in the other mutually perpendicular plane. Terminals 28 and 30 are provided on the guitar to electrically connect the transducer assembly 16 with the amplifiers 24 and 25. As shown in FIG. 2, a separate pair of terminals **28*a* and 30*a* could be provided for each individual transducer 14 of the assembly 16 thereby providing a pair of separate signals from each individual string, or various electrical signals can be summed together at the single terminals 28 and 30 as shown in FIG. 7**.

The operational concept of the transducer 14 is generally illustrated in FIG. 2. Each transducer comprises a first pole piece 32 and a second pole piece 34. Each pole piece is formed of magnetically permeable material which, in association with the adjacent structures and the space in close proximity, possesses a certain magnetic reluctance. Means for creating magnetic flux flowing within and out of the pole pieces 32 and 34 is also provided. In the transducer 14 shown in FIG. 2, the pole pieces 32 and 34 are permanent magnets and the magnetic material thereof creates the magnetic flux. Each pole piece 32 and 34 is formed with a pole face 36 and 38, respectively, of predetermined configuration for orienting the magnetic flux flowing out of the pole piece into a predetermined pattern. The magnetic flux emanating from the pole faces 36 and 38 into the space or air gap area adjacent the string 12 is a predetermined pattern aligned substantially parallel to the two planes X and Y, respectively.

A planar configuration is one predetermined configuration of the pole faces 36 and 38 which achieves the effect of orienting the flux patterns in the vicinity of the string in the mutually perpendicularly intersecting relation. The magnetic flux tends to emanate from or exit the pole piece in a direction substantially perpendicular to the plane of the pole face surface at the point of exit. As the flux travels into space beyond the pole face, the flux lines may bend according to other influences. It is possible that other non-planar pole face configurations can be utilized which particularly arrange the flux lines in the area adjacent the non-vibrating string into an intersecting, mutually perpendicular flux pattern.

The pole pieces 32 and 34 and their pole faces 36 and 38 respectively are positioned and supported in predetermined relation to the string 12. This predetermined supported relation causes the magnetic flux exiting from pole piece 32 at its pole face 36 to intersect the string 12 in a manner generally parallel to the X plane. The magnetic flux exiting the pole piece 34 at its pole face 38 intersects the string 12 in a pattern generally parallel to the Y plane and substantially perpendicular to the X plane.

The strings 12 of a typical musical instrument are generally of magnetically permeable material such as steel. However, non-magnetically permeable strings can be made magnetically permeable by attaching a small foil of magnetically permeable material around the strings in the vicinity where the magnetic flux from the pole pieces intersects the string. The string 12 is positioned at a predetermined distance from the pole faces 36 and 38 and within the flux pattern emanating from the pole pieces whereby string vibratory motion in the X and Y planes influences the magnetic reluctanace of the path in which the flux flows. As the string 12 vibrates toward and away from the pole face 36, the reluctance of magnetic flux path through the pole piece 32 changes in relation to the distance of the string 12 from the pole face 36. Since the distance of the string from the pole face 36 varies directly in accordance with the vibrational frequency of the string in the X plane, the reluctance changes are directly related to the vibrational frequency of the string. A similar effect creates reluctance changes in the magnetic flux path through pole piece 34 as a result of vibratory motion of the string 12 in the Y plane toward and away from the pole face 38.

A change in reluctance in each magnetic flux path causes a related change in the magnitude of magnetic flux flowing in the pole piece within the magnetic flux path. In order to supply an electrical signal related to the change in flux in each pole piece, electrical coils 40 and 42 are formed around pole pieces 32 and 34, respectively. The electrical coils 40 and 42 are defined by a plurality of series connected individual loops or coils of electrical conductors 44 and 46 respectively. Changes in magnetic flux through the pole pieces induce an electrical voltage signal in the sensing coils 40 and 42, and the signals are applied over the conductors 44 and 46 to a pair of terminals 28*a* and 30*a* respectively connected to the conductors 44 and 46.

Since the pole pieces and pole faces are supported to cause the magnetic flux from each pole face 36 and 38 to respectively intersect the string 12 in a mutually perpendicular relationship, movement of the string in one plane does not cause magnetic flux changes in the pole piece emanating magnetic flux parallel to the other plane. For example, movement of the string in the X plane does not cause substantial flux changes in the pole piece 34 because the string 12 remains essentially at the same distance from the pole face 38, and vice versa. Some bending and interaction of the magnetic flux emanated from the pole faces 36 and 38 may occur in the vicinity of the string 12, but this distortion from a strictly perpendicular orientation in the vicinity of the string is not so significant to prevent separate flux changes in the pole pieces 32 and 34 in accordance with the reluctance changes caused by vibratory string motion in the X and Y planes, respectively.

Because the pole pieces, the pole face configurations, and the predetermined magnetic flux pattern in the vicinity of the string are arranged in accordance with the invention to have maximum affect on the flux in one pole piece and a minimum or no effect on the flux of the other pole piece from string vibration in a single plane, separate electrical signals are derived from the string movements in each of the two mutually perpendicular planes. The predetermined distance of the string from the pole faces, the amount of flux flowing through and created within each pole piece and the number of individual conductor coils of each sensing coil are all related in a predetermined manner to provide voltage output signals on terminals 28*a* and 30*a* which themselves are sufficient to drive an audio amplifier 24 or 26 (FIG. 1) directly without the necessity for further elaborate electronic signal processing, conditioning and the like.

A skilled musician can utilize the transducers of the present invention to create uniquely sounding musical styles and effects not previously appreciated. Significantly perceptible differences in sound result from the string vibration in each of the two mutually perpendicular planes. The overall sound available from the transducer of the present invention, when compared to the sound available from conventional transducers, may be subjectively described as fuller or fatter with greater dimension. The different signals from the sensing coils create a stereo-type image determined by the manner in which the instrument is played. By plucking the string back and forth in a transverse direction between the two pole pieces, the initial linear vibration of the string in a transverse direction will alternately induce the primary signals in the pole pieces. The back and forth string plucking will cause the sound image to move back and forth across a stereo dimension defined by the space between the two separated speakers 26 and 27 (FIG. 1). A musician can also fret the string in such a manner to bend or displace the string from its normal position between the two pole faces toward one of the pole pieces and away from the other. Bending the string closer to one pole face increases the amplitude of the signal supplied by one sensing coil decreases the amplitude of the signal supplied by the other sensing coil, which will cause the amplitude of the sound image to move toward one side of the stereo dimension between the two separated speakers. It is also possible for a skilled musician to create a subtle flanging or phasing effect. This phasing or flanging effect is controlled by plucking the string at successive intervals along the length of the string, thereby causing successive variations in vibration attack and sustain patterns of the vibrating string. The rate at which the phasing occurs is determined by the rate at which the plucking is moved along intervals of the string. These and other unique effects are under the simultaneous yet independent control of the musician.

The described unique musical effects achieved by the transducers of the present invention are the direct result of the vibration sensing capabilities. No elaborate additional electronic equipment, such as signal processing equipment and the like, is necessary other than the conventional audio amplifiers 24 and 25 and the conventional speakers 26 and 27. The transducers of the present invention are directly adaptable to a conventional guitar or other stringed instrument, or can be substituted for a conventional pick-up without significant modification to the instrument or the audio amplifying equipment of the musician.

Figure 3:
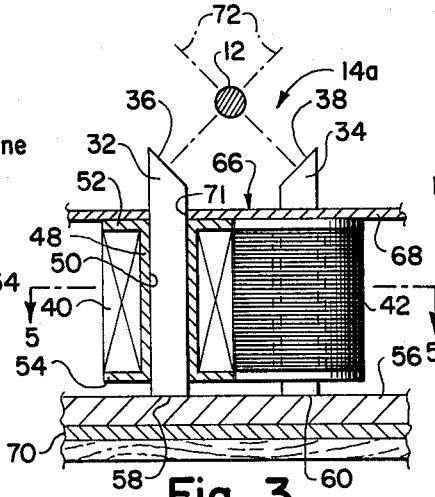
FIG. 3 is a side view, partially in elevation and partially in section of one embodiment of a transducer of the present invention viewed in a plane perpendicular to the longitudinal extension of a string of a stringed instrument.
Figure 5:
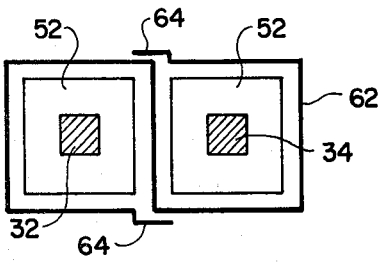
FIG. 5 is a section view taken substantially in the plane of lines 5—5 in either of FIGS. 3 or 4.

Preferred structure of one actual embodiment 14*a* of the transducer can be understood by reference to FIG. 3. The pole pieces 32 and 34 are preferably formed from elongated bars of magnetically permeable material. Coil forms 48 generally take the configuration of a reel or a bobbin and include center openings 50 within which the pole pieces are received. The sensing coils 40 and 42 are defined by a predetermined plurality of turns of an electrical conductor wound around the middle portion of the coil form 48 between end flanges 52 and 54 of each coil form. A permanent magnet 56 contacts ends 58 and 60 of the pole pieces 32 and 34 respectively. The permanent magnet 56 creates the magnetic flux flowing in the pole pieces 32 and 34. A metallic magnetically permeable shield 62 (FIG. 5) extends between the end flanges 52 and 54 and completely surrounds each sensing coil 40 and 42. The shield 62 may be formed of a single piece of metallic material shaped in a figure eight as shown in FIG. 5, to simultaneously slide over both sensing coils and coil forms. Offset ends 64 overlap the middle portion of the metallic shield and assure a complete magnetic shield around each sensing coil. The shield 62 shields the sensing coils 40 and 42 from the influence of external spurious magnetic flux and helps reduce the induction of spurious electrical signals in the sensing coils. Each transducer 14*a* is held in assembled relation and positioned on the guitar body 18, and the pole pieces and pole faces are positioned relative to the string 12 by a support means or housing 66 having an upper wall 68 and a lower wall 70. Openings 71 are formed in the upper wall 68 to allow ends of the pole pieces 32 and 34 to protrude therethrough and be supported adjacent the string on opposite transverse sides of the string.

In the embodiment 14*a* of the transducer shown in FIG. 3, the pole faces 36 and 38 are formed on the pole pieces 32 and 34 respectively, by making a planar cut at approximately a 45° angle with respect to the longitudinal extention of the pole pieces. The pole faces 36 and 38 both directly face the string 12 and are approximately the same distance from the string 12 under non-vibratory conditions. Imaginary lines 72 which extend perpendicularly from the planar pole faces 36 and 38, respectively, intersect at the string 12. Magnetic flux emanating from the pole faces 36 and 38 generally intersects the string 12 in essentially a mutually perpendicular relationship due to the described geometry. Of course, the planes defined by the pole faces 36 and 38 are also mutually perpendicular with respect to one another.

Figure 4:
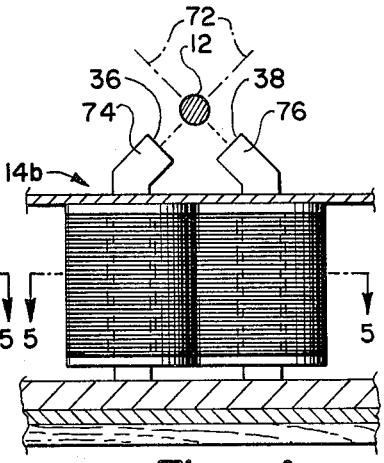
FIG. 4 is a view similar to FIG. 3 of another embodiment of the transducer of the present invention.

In the embodiment 14*b* of the transducer shown in FIG. 4, the ends 74 and 76 of the pole pieces 32 extend above the top surface 68 of the housing 66 and are bent in a direction to converge toward the string 12. The configuration of the pole faces 36 and 38 is planar. The pole faces 36 and 38 extend transversely and generally perpendicularly with respect to the extension of the ends 74 and 76. The planar orientation of the pole face configurations 36 and 38 in the embodiment 14*b* shown in FIG. 4 defines essentially similar pole face geometry and produces an essentially similar flux pattern in the vicinity of the string as has been previously described.

A plurality of individual transducers, for example those referenced 14*a*, are assembled into the transducer assembly 16, as shown in FIG. 6. One individual transducer is provided in the assembly 16 for each string 12 of the stringed instrument. Each individual transducer provides signals representative of the vibrational movement of the string with which the transducer is associated. Screws 80 or other conventional fastening devices are utilized for attaching the housing 66 of the transducer assembly 16 to the guitar body 18. It should be noted that the pole faces 36 and 38 in the assembly 16 are positioned in a line extending transversely with respect to the longitudinal extension of the strings and are positioned in next adjacent relation to the string whose vibrations are sensed. Therefore, it can be seen from FIG. 6 that no other pole piece is interposed between each string 12 and the two pole pieces presenting the pole faces 36 and 38 operative with respect to that string. Each transducer senses the vibrational movement of its associated string at approximately corresponding places along the length of the strings.

The sensing coils of each transducer of the transducer assembly may be electrically connected in a variety of different manners, one of which is illustrated in FIG. 7. Two individual transducers 14*c* are schematically illustrated. The sensing coils 40 of the two pole pieces 32 on the same transverse side of the strings 12 are electrically connected through resistors 82 and 84 to the terminal 30 which also serves as a summing junction. Resistors 82 and 84 are of value selected to provide the desired magnitude of the individual signals derived from each of the sensing coils 40. Similarly, the sensing coils 42 surrounding the pole pieces 34 are electrically connected through resistors 86 and 88 to the terminal 28. The electrical arrangement illustrated in FIG. 7 sums all of the first set of electrical signals derived from vibrational movement of all or a plurality of strings in one set of parallel planes and sums the second set or the remainder of the electrical signals derived from vibrational movement of the strings in the set of mutually perpendicular planes. Although not shown, the signals supplied by each individual sensing coil could be separately supplied to a separate amplifier, or connected by one of the known techniques to achieve interference cancellation, e.g. "Humbucking".

Preferred embodiments of the transducer of the present invention, as well as its operational principles and significant improvements and advantages over the prior art have been described with a degree of particularity. It should be understood, however, that the specificity of the present disclosure has been made by way of example, and that changes in detail of structure and features may be made without departing from the spirit of the invention defined by the appended claims.

What is claimed is:

1. A transducer for a stringed instrument having at least one magnetically permeable string, said transducer being of the variable reluctance type for obtaining electrical signals respectively corresponding to vibrational movement of the string in two mutually perpendicular planes, comprising:

first and second magnetically permeable pole pieces;

magnetic means for creating a magnetic flux in each of said pole pieces;

first and second pole faces formed respectively on said first and second pole pieces, each said pole face for emanating magnetic flux from the pole piece upon which said pole face is formed;

support means for supporting and positioning said first and second pole pieces relative to the string, said support means positioning said pole faces in stationary predetermined positions relative to said string under non-vibratory conditions, said support means also positioning said first pole face from said string at a predetermined distance at which vibratory motion of said string in a first plane toward and away from said first pole face changes the magnetic flux in said first pole piece by a substantially greater amount than any change in the magnetic flux in said second pole piece, said support means also positioning said second pole face from said string at a predetermined distance at which vibratory motion of said string in a second plane toward and away from said second pole face changes the magnetic flux in said second pole face by a substantially greater amount than any change in magnetic flux in said first pole piece, said support means further positioning both pole faces in a predetermined configuration by which vibratory motion of the string in the first plane is substantially perpendicular to vibratory motion of the string in the second plane, said support means including said magnetic means, means associated with said first pole piece for supplying a first electrical signal related to the change in flux in said first pole piece; and means associated with said second pole piece for supplying a second electrical signal related to the change in flux in said second pole piece.

2. A transducer for a stringed instrument having at least one magnetically permeable string, said transducer being of the variable reluctance type for obtaining electrical signals corresponding to vibrational movement of the string in two mutually perpendicular planes, comprising:

first and second magnetically permeable pole pieces;

magnetic means for creating a magnetic flux in each of said pole pieces;

first and second pole faces formed respectively on said first and second pole pieces, each pole face having a predetermined configuration for orienting the magnetic flux emanating from said pole face in a predetermined pattern within a predetermined distance from said pole face;

support means for supporting and positioning said first and second pole pieces relative to said string and for positioning said first and second pole faces in stationary predetermined positions relative to said string under non-vibratory conditions, said support means also for positioning said first and second pole faces within the predetermined distance from said string within which the magnetic flux respectively emanating from said first and second pole faces is oriented in the predetermined pattern, said support means adapted also to position both pole faces at a predetermined distance from said string within which vibratory string motion toward and away from each pole face changes the magnetic flux in the pole piece upon which said each pole face is formed, said support means also adapted to position both said pole faces relative to said string under non-vibratory conditions in a predetermined configuration by which the predetermined flux pattern from said first pole face is essentially mutually perpendicular to the predetermined flux pattern from said second pole face, said support means including said magnetic means;

means associated with said first pole piece for supplying a first electrical signal related to the change in flux in said first pole piece; and means associated with said second pole piece for supplying a second electrical signal related to the change in flux in said second pole piece.

3. A transducer for a stringed instrument having at least one string, said transducer being of the variable reluctance type for sensing vibratory motion of the string in each of two mutually perpendicular planes, comprising:

first and second magnetically permeable pole pieces;

magnetic means for creating a magnetic flux in each of said pole pieces;

support means for supporting said first and second pole pieces on respectively opposite transverse sides of said string and in substantially stationary predetermined positions relative to said string under non-vibratory conditions, said support means including said magnetic means;

first and second pole faces formed respectively on ends of said first and second pole pieces, each pole face having a predetermined configuration in regard to the predetermined position at which the pole piece is supported relative to the string for directing magnetic flux emanating from the pole piece substantially toward said string and for directing magnetic flux from one pole piece toward said string substantially perpendicular to the direction which magnetic flux from the other pole piece is directed toward said string;

said support means adapted to support each pole piece with each pole face spaced from said string a predetermined distance at which the magnetic flux emanating from each pole face intersects the string and at which vibratory string motion toward and away from one pole face substantially only changes the magnetic flux in the pole piece upon which said one pole face is formed;

a first winding defined by a plurality of series connected coils of an electrical conductor formed around said first pole piece, said first winding being adapted to supply a first electrical signal representative of any change in flux in said first pole piece; and a second winding defined by a plurality of series connected coils of an electrical conductor formed around said second pole piece, said second winding being adapted to supply a second electrical signal representative of any change in flux in said second pole piece.

4. A transducer as defined in claims 1 or 3 wherein a substantial amount of the flux respectively emanated from said first and second pole faces is oriented to intersect said string at a respective mutually perpendicular angle.

5. A transducer as defined in claim 3 wherein the predetermined configurations of said pole faces result in significantly greater changes in the magnetic flux in one pole piece than in the other pole piece, upon vibratory movement of said string toward and away from one pole face.

6. A transducer as defined in claims 1 or 2 wherein said support means positions said pole pieces on transversely opposite sides of said string.

7. A transducer as defined in claims 1, 2 or 3 wherein said support means positions each pole face substantially the same distance from said string under non-vibratory conditions.

8. A transducer as defined in claims 1, 2 or 3 wherein each pole piece comprises an elongated bar and the pole face extends transversely across an end of the bar and said bar is bent adjacent the end upon which the pole face is formed.

9. A transducer as defined in claims 1, 2 or 3 wherein each pole piece comprises an elongated bar and the pole face extends transversely across an end of the bar generally at an acute angle relative to the length of the bar at the end.

10. A transducer as defined in claims 1, 2 or 3 wherein said first and second electrical signals are substantially only audio frequency signals of predetermined strength to directly supply input to an audio amplifier, said first and second signals being distinguishable from one another in accordance with different vibratory string motion in each of the two mutually perpendicular planes.

11. A transducer as defined in claims 1, 2 or 3 in combination with a stringed instrument having a body and a plurality of strings extending in a plane, and wherein in said combination:

a first pole piece and a second pole piece are operatively associated with each string of the plurality of strings of the instrument; and said support means is operatively connected to said body and positions said pole faces of said pole pieces generally below the plane defined by said plurality of strings, said support means also positions each first pole face on corresponding transverse sides of each string and positions each second pole face on the corresponding opposite transverse side of each string.

12. A transducer as defined in claims 1, 2 or 3 wherein each said pole face configuration is planar and the plane of said first pole face extends substantially perpendicular to the plane of said second pole face.

13. An invention as defined in claim 11 wherein:

said support means positions the first and second pole pieces of each group of first and second pole pieces in next adjacent relation with the one string associated with each group and without interposition of any other pole piece between said one string and the first and second pole pieces of said group.

14. An invention as defined in claim 11 wherein each pole piece comprises an elongated bar and the pole face extends transversely across an end of said bar and said bar is bent adjacent the end upon which the pole face is formed.

15. An invention as defined in claim 11 wherein each pole piece comprises an elongated bar and the pole face extends transversely across an end of said bar generally at an acute angle relative to the length of the bar at the end.

* * * * *